US009084482B2

(12) United States Patent
Botkin

(10) Patent No.: US 9,084,482 B2
(45) **Date of Patent: *Jul. 21, 2015**

(54) SHELVING SYSTEMS AND COMPONENTS THEREFOR

(71) Applicant: Kirk J. Botkin, Martinsville, IN (US)

(72) Inventor: Kirk J. Botkin, Martinsville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/868,619

(22) Filed: Apr. 23, 2013

(65) Prior Publication Data

US 2014/0116972 A1 May 1, 2014

Related U.S. Application Data

(63) Continuation of application No. 12/525,432, filed as application No. PCT/US2008/052687 on Jan. 31, 2008, now Pat. No. 8,424,466.

(60) Provisional application No. 60/898,539, filed on Jan. 31, 2007.

(51) Int. Cl.

| | |
|---|---|
| ***A47B 23/00*** | (2006.01) |
| ***A47B 57/54*** | (2006.01) |
| ***A47B 96/06*** | (2006.01) |
| ***A47G 25/06*** | (2006.01) |

(52) U.S. Cl.

CPC ..... *A47B 57/545* (2013.01); *A47B 96/06* (2013.01); *A47B 96/067* (2013.01); *A47G 25/06* (2013.01)

(58) Field of Classification Search

CPC .... A47B 96/02; A47B 96/022; A47B 96/027; A47B 96/061; A47B 23/04; A47B 57/42; A47B 5/02

USPC ..... 108/42, 44, 47, 108, 106, 152, 110; 211/187; 248/243, 235, 245, 244, 250, 248/246

See application file for complete search history.

(56) References Cited

U.S. PATENT DOCUMENTS

| | | | |
|---|---|---|---|
| 288,058 | A | 11/1883 | Hollister |
| 698,272 | A | 4/1902 | Glover |
| 1,247,938 | A | 11/1917 | Curtenius |
| 1,802,245 | A | 4/1931 | Foretich |
| 2,894,642 | A | 7/1959 | Clevett, Jr. et al. |
| 2,895,616 | A | 7/1959 | Erdmann |
| 3,510,097 | A | 5/1970 | McCaleb |
| 3,921,539 | A | 11/1975 | Berger |
| 3,993,002 | A | 11/1976 | Stroh |
| 4,079,678 | A | 3/1978 | Champagne |

(Continued)

FOREIGN PATENT DOCUMENTS

| | | |
|---|---|---|
| GB | 6413 | 0/1892 |

*Primary Examiner* — Jose V Chen

(74) *Attorney, Agent, or Firm* — Woodard, Emhardt, Moriarty, McNett & Henry LLP

(57) ABSTRACT

A shelf apparatus according to one embodiment of the present invention includes first and second upstanding posts each having a plurality of horizontally-extending grooves in an external surface thereof, the grooves spaced vertically from one another. First and second shelf support clamps are supported by the first and second posts, respectively. The clamps each have a clamp body received only partially about its corresponding post, and the clamps each include a horizontally-extending protuberance such as a rib received in one of the grooves of its respective post. The apparatus further includes first and second shelf brackets supported by the first and second clamps, respectively, and a shelf supported by the first and second shelf brackets.

24 Claims, 12 Drawing Sheets

(56) References Cited

U.S. PATENT DOCUMENTS

| | | | |
|---|---|---|---|
| 4,128,064 | A | 12/1978 | Chung et al. |
| 4,150,753 | A | 4/1979 | Stahl et al. |
| 4,155,459 | A | 5/1979 | Marschak |
| 4,186,666 | A | 2/1980 | Honickman |
| 4,194,637 | A | 3/1980 | Edson |
| 4,322,006 | A | 3/1982 | Marschak |
| 4,323,215 | A | 4/1982 | Berger |
| 4,502,602 | A | 3/1985 | Swanson |
| 4,582,001 | A | 4/1986 | Leikarts |
| 4,671,417 | A | 6/1987 | O'Brien |
| 4,750,700 | A | 6/1988 | Wade |
| 4,754,712 | A | 7/1988 | Olson et al. |
| 4,782,918 | A | 11/1988 | Brunner et al. |
| 4,889,304 | A | 12/1989 | Glickman et al. |
| 4,919,280 | A | 4/1990 | Phillips |
| 4,936,565 | A | 6/1990 | Fredrickson |
| 5,109,993 | A | 5/1992 | Hutchison |
| 5,354,103 | A | 10/1994 | Torrence et al. |
| 5,370,249 | A | 12/1994 | Harvey et al. |
| 5,492,295 | A | 2/1996 | Remmers |
| 5,529,192 | A | 6/1996 | Conen et al. |
| 5,582,376 | A | 12/1996 | Thompson |
| 5,607,070 | A | 3/1997 | Hellyer |
| 5,611,438 | A | 3/1997 | Dye |
| 5,626,243 | A | 5/1997 | Brozak, Jr. |
| 5,676,258 | A | 10/1997 | Leyden et al. |
| 5,678,702 | A | 10/1997 | Menaged et al. |
| 5,803,274 | A | 9/1998 | Scheveloff |
| 5,833,077 | A | 11/1998 | Engel |
| 5,908,119 | A | 6/1999 | Kump et al. |
| 5,927,517 | A | 7/1999 | Lipman et al. |
| 6,015,124 | A | 1/2000 | Loy |
| 6,029,827 | A | 2/2000 | Valiulis |
| 6,053,115 | A | 4/2000 | Felton |
| 6,113,042 | A | 9/2000 | Welsch et al. |
| 6,123,033 | A | 9/2000 | Polley et al. |
| 6,186,455 | B1 | 2/2001 | Hollingsworth et al. |
| 6,193,083 | B1 | 2/2001 | Wood |
| 6,209,831 | B1 | 4/2001 | Kiplinger |
| 6,234,436 | B1 | 5/2001 | Kump |
| 6,431,090 | B1 | 8/2002 | Davis et al. |
| 6,474,244 | B1 | 11/2002 | Karpinski |
| 6,502,900 | B1 | 1/2003 | Johnston |
| 6,769,656 | B1 | 8/2004 | Botkin |
| 7,051,984 | B2 | 5/2006 | Botkin |
| 7,658,153 | B1 | 2/2010 | Patoka |
| 7,900,783 | B2 | 3/2011 | Fernandez et al. |
| 8,424,466 | B2 * | 4/2013 | Botkin ..... 108/42 |
| 2006/0102817 | A1 | 5/2006 | Swartz et al. |

* cited by examiner

SHELVING SYSTEMS AND COMPONENTS THEREFOR

REFERENCE TO RELATED APPLICATIONS

The present application is a continuation of U.S. patent application Ser. No. 12/525,432, filed Jul. 31, 2009, now U.S. Pat. No. 8,424,466, issued Apr. 23, 2013, which is a national stage application of International Application No. PCT/US2008/052687, filed Jan. 31, 2008, abandoned, which claims the benefit of U.S. Provisional Patent Application Ser. No. 60/898,539, filed Jan. 31, 2007, each entitled Shelving Systems and Components Therefor, and all of which are hereby incorporated by reference in their entirety.

BACKGROUND OF THE INVENTION

This invention relates to shelving systems and components therefore, and in one particular aspect, to an easily assembled and installed shelving system that may be customized suit a user's particular needs.

It is often desirable or even necessary to provide shelving for storage and/or display of items in various places such as a closet, a storage room, a workroom, a utility room, an office, a garage, or a retail store. Many different types of shelving systems are known in the art, including various metal, wood or plastic systems that may be shipped and/or sold to the user in an unassembled state and subsequently assembled and installed by the user in a desired location.

For example, one prior art metal shelving unit consists of a number of metal shelves and four elongated, vertical corner pieces. Such units are sold in pieces, and require the user to attach the corners of the metal shelves to the corner pieces by a nut and bolt assembly or the like. This type of shelving system requires a large number of individual pieces and various tools for assembly. Also, assembly configurations are limited in this type of a system, and thus there is limited opportunity for the user to customize the system to meet his or her needs.

Other prior art shelving systems include modular shelving systems constructed in a number of pieces from a material such as wood and/or metal. The separate pieces of the system are designed to be mounted together using hardware such as screws, latches and/or nut and bolt assemblies. Again, this type of shelving system requires a large number of pieces and various tools for assembly. In addition, such systems are often difficult, time consuming and confusing to assemble, leading to frustration and wasted time on the part of the user. Further, once assembled, such systems are difficult and time consuming to disassemble and modify, which may be required as the needs of the user change.

Still another type of prior art shelving system often utilized in closets consists of a number of shelves made of a plurality of welded, coated wires. The shelves are typically mounted to a wall by the user using screws and the like, often making installation difficult and time consuming, particularly to a user who may not be particularly handy. Such systems, while lightweight, do not present a sturdy appearance due to the gaps that exist between the wire supports. In addition, items that are smaller than the gaps between the small, one-eighth inch diameter wire supports may not be stored with this type of system as those items will fall through the gaps.

There is therefore a need for a shelving system that is quick and easy to assemble and disassemble with very limited or no use of separate tools. There is further a need for such a shelving system that may be customized by a user to meet certain needs, that is attractive, and that may be easily and readily reconfigured and adjusted as needs change.

BRIEF SUMMARY

In accordance with one aspect, the present invention provides a shelf apparatus that includes a first and second upstanding posts each having a plurality of horizontally-extending grooves in an external surface thereof, the grooves spaced vertically from one another. First and second shelf support clamps are supported by the first and second posts, respectively. The clamps each have a clamp body received only partially about its corresponding post, and the clamps each include a horizontally-extending rib received in one of the grooves of its respective post. The apparatus further includes first and second shelf brackets supported by the first and second clamps, respectively, and a shelf supported by the first and second shelf brackets.

In another embodiment, the present invention provides a shelf support clamp for mounting on a shelf support post having a substantially horizontal groove. The shelf support clamp includes a clamp body defining an interior channel for receipt about the shelf support post, the interior channel including a top opening, a bottom opening, and a side opening. The clamp body further defines a protuberance into the interior channel for receipt within the groove of the shelf support post. Additional aspects of the invention are provided by combinations of such a clamp with a shelf support post and/or a shelf support bracket.

In a further embodiment, the invention provides as shelf apparatus that includes a rail mounted on a wall, the rail including an elongate opening. First and second post members are supported by the rail, and each includes a first portion engaged in said elongate opening, a downwardly-depending arm connected to the first portion, and a second portion attached to said arm and contacting the wall at a position below the rail. At least one shelf is supported by the first and second post members.

Additional embodiments of the invention as well as features and advantages thereof will be apparent to those of ordinary skill in the art from the descriptions herein.

DETAILED DESCRIPTION

Figure 1:
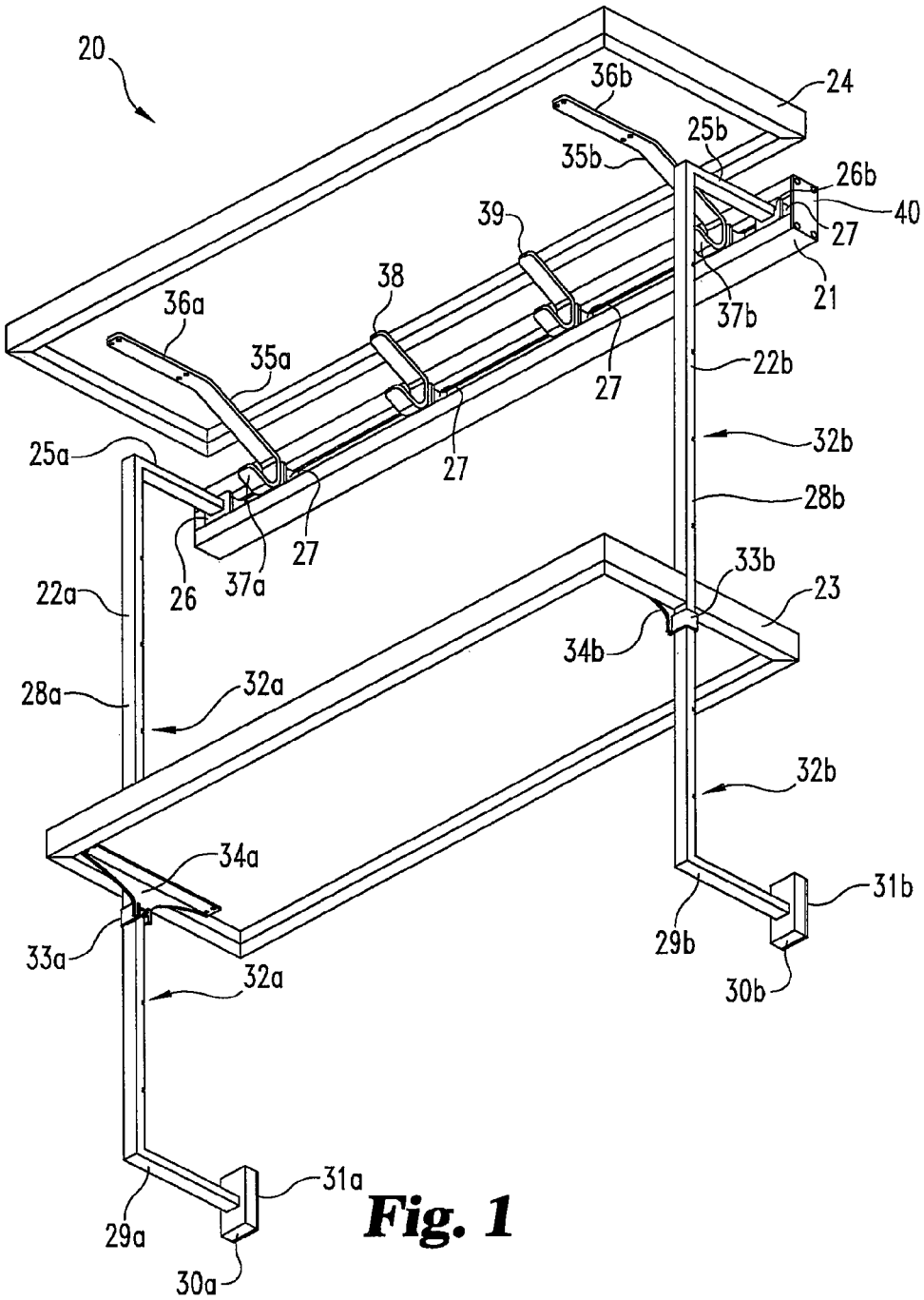
FIG. 1 is a perspective view of a shelf apparatus according to one embodiment of the present invention.

For the purposes of promoting an understanding of the disclosure, reference will now be made to the embodiments illustrated in the drawings and specific language will be used to describe the same. It will nevertheless be understood that no limitation of the scope of the disclosure is thereby intended, such alterations and further modifications in the illustrated device and its use, and such further applications of the principles of the disclosure as illustrated therein being contemplated as would normally occur to one skilled in the art to which the disclosure relates.

With reference to FIGS. 1-4, shown is a shelving system or apparatus 20 in accordance with the present invention. Shelving system 20 includes a rail 21 mounted to a wall 200 or other suitable support structure. Shelving system 20 further includes a first downwardly depending shelf support post 22*a* and a second downwardly depending shelf post 22*b* laterally spaced therefrom. At least one shelf 23 and optionally multiple such shelves are supported by posts 22*a* and 22*b*. System 20 further includes an upper shelf 24 supported by and occurring above rail 21. Posts 22*a* and 22*b* include upper horizontal arms 25*a* and 25*b* which include respective mount plates 26*a* and 26*b* attached to the ends thereof. Mount plates 26*a* and 26*b* in turn are connected to rail-engaging pucks 27, to be described further hereinafter.

Posts 22*a* and 22*b* further include downwardly depending and preferably vertically oriented arms 28*a* and 28*b* which in turn are connected to lower horizontal arms 29*a* and 29*b*. Bumper plates 30*a* and 30*b* are attached to the ends of lower horizontal arms 29*a* and 29*b*, and have mounted thereon soft or resilient pads 31*a* and 31*b* constructed of a suitable material that will be non-damaging to the wall or other structure against which system 20 is mounted. Bumper plates 30*a* and 30*b* and associated pads 31*a* and 31*b* provide a lower point of contact with the wall or other structure and need not (but may be) be permanently attached thereto.

Posts 22*a* and 22*b* include a plurality of grooves or notches 32*a* and 32*b* spaced along downwardly depending arms 28*a* and 28*b*. In the illustrated preferred embodiment, grooves or notches 32*a* and 32*b* occur only on the inward face of the arms 28*a* and 28*b* (i.e. that face directed toward the wall 200 or other structure upon which system 20 is mounted). In this manner, the outwardly facing and lateral surfaces of arms 28*a* and 28*b* can be free of grooves and thereby enhanced in appearance. Shelf 23 is supported by arms 28*a* and 28*b* by a support combination including support clamps 33*a* and 33*b* which cooperate with grooves 32*a* and 32*b* to fix their vertical position, and by shelf brackets 34*a* and 34*b* which cooperate with support clamps 33*a* and 33*b* and in turn support shelf 23.

Figure 17:
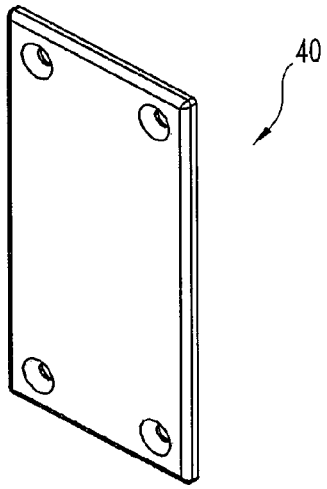
FIG. 17 is a perspective view of an endplate comprising one portion of the FIG. 1 apparatus.

Upper shelf 24 is supported by a first rail-supported bracket 35*a* and second rail-supported bracket 35*b*. Brackets 35*a* and 35*b* include upper portions 36*a* and 36*b* attached to the bottom of shelf 24, as well as lower hooks 37*a* and 37*b* which can, for example, be used to hang bags, coats or other objects. Shelf system 20 can include additional hooks or prongs 38 and 39 for hanging or otherwise supporting objects. Brackets 35*a* and 35*b* and hooks 38 and 39 are each attached to a rail-engaged puck 27 as discussed further hereinafter. Further, the ends of rail 21 can be capped with an endplate 40 attached to rail 21 by screws 41 or other appropriate connectors. Endplate 40 is depicted in greater detail in FIG. 17.

Figure 3:
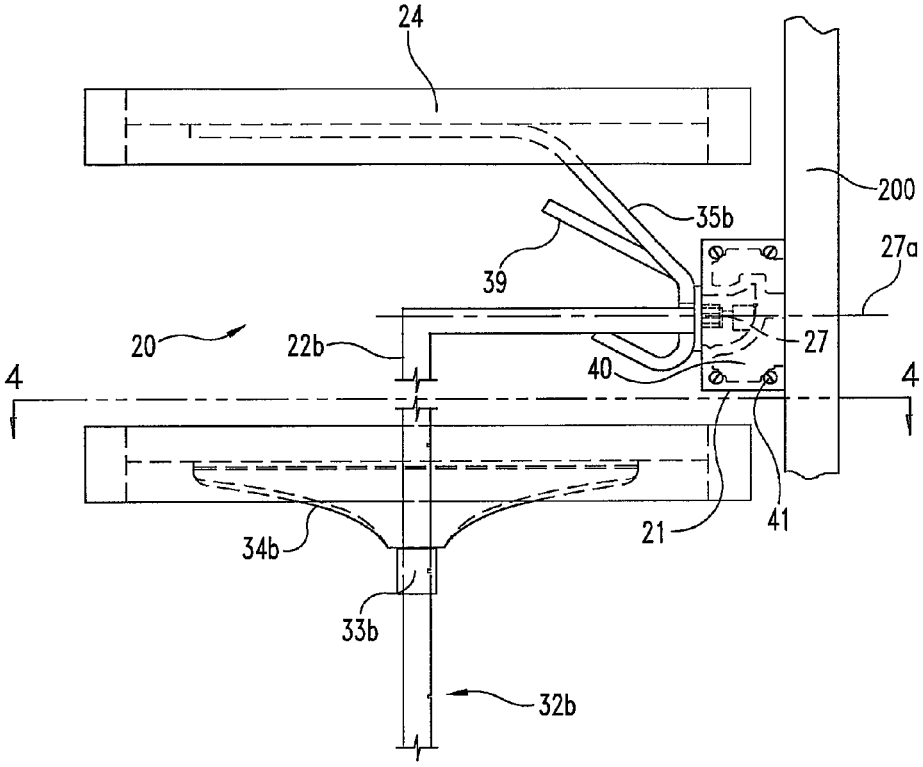
FIG. 3 is a side elevational view of the FIG. 1 apparatus.
Figure 4:
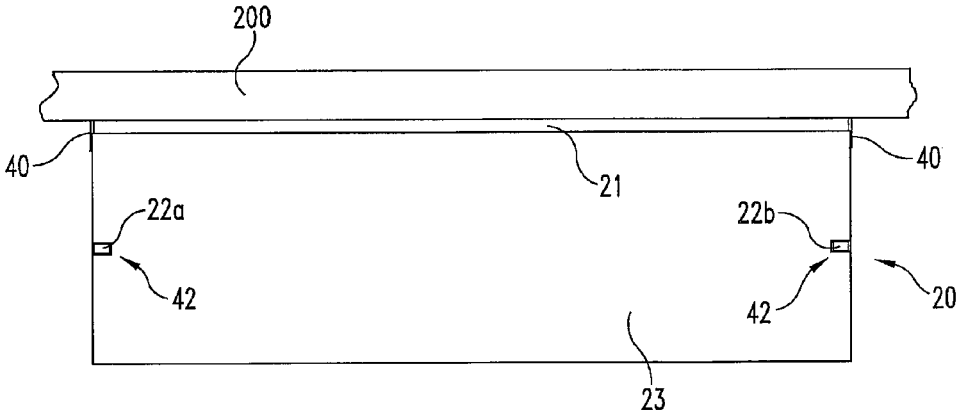
FIG. 4 is a sectional view taken along line 4-4 of FIG. 3 and viewed in the direction of the arrows.

With reference now particularly to FIG. 4, shown is a sectional view taken along line 4-4 of FIG. 3 and viewed in the direction of the arrows. Shown is an upper view of shelf 23 of system 20. Shelf 23 includes notches 42 which accommodate posts 22*a* and 22*b*, respectively, thus allowing for a wider shelf than that which would be provided with a shelf whose edges were received inward of posts 22*a* and 22*b*. Nonetheless, such narrower shelf arrangements are also considered a part of the present invention.

Figure 5:
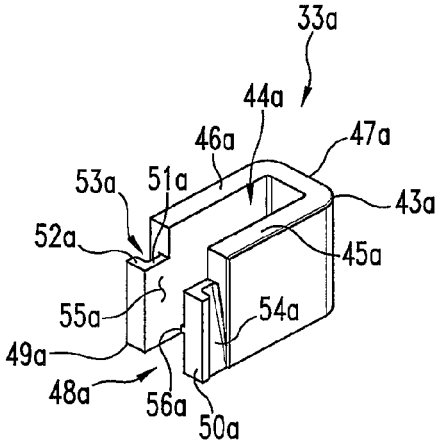
FIG. 5 is a perspective view of a shelf support clamp according to one embodiment of the invention.
Figure 6:
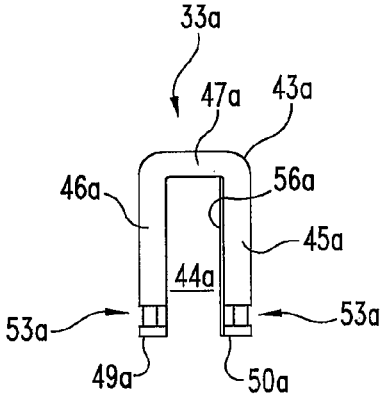
FIG. 6 is a top view of the clamp of FIG. 5.

With reference now to FIGS. 5 and 6, illustrated in more detail is support clamp 33*a* of system 20. Clamp 33*a* includes a clamp body 43*a* defining an inner channel 44*a*. Inner channel 44*a* is sized and configured to receive arm 28*a* of post 22*a*. Channel 44*a* is defined by a first wall portion 45*a* and an opposite parallel wall portion 46*a* interconnected by a transverse wall 47*a*. These wall portions and the overall configuration of clamp 33*a* provide a side opening 48*a* accessing channel 44*a*. Thus, clamp 33*a* defines a structure that is not completely closed (i.e. partially open). Clamp 33*a* further includes generally "L"-shaped receivers 49*a* and 50*a* received on the end faces of walls 46*a* and 45*a*, respectively. Receivers 49*a* and 50*a* each include a first wall portion 51*a* extending generally axially with walls 46*a* and 45*a* and a second wall portion 52*a* extending transversely and preferably perpendicularly thereto, thus generally forming the "L" shape. Defined between the end faces of walls 46*a* and 45*a* and wall portions 52*a* are vertically-extending slots 53*a* for receiving portions of a shelf bracket as discussed hereinafter. Slots 53*a* desirably include surfaces 54*a* which are inclined relative to vertical, extending outwardly from an uppermost portion thereof toward the lowermost portion thereof. Channel 44*a* is defined by wall surfaces 55*a* which include a lip or rib 56*a* or other similar protuberance which is configured to cooperate with grooves, notches or other openings 32*a* in post 22*a*.

Figure 6A:
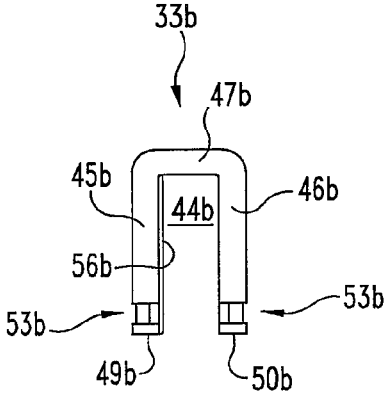
FIG. 6A is a top view of a clamp constructed as a mirror image of the clamp of FIGS. 5 and 6.

With reference to FIG. 6A, shown is a top view of support clamp 33*b* which resides opposite support clamp 33*a* in system 20. Support clamp 33*b* has parts corresponding to those of clamp 33*a* (appearing with corresponding part numbers "b"), but is structured as a mirror image thereof, with clamp 33*a* providing a left-hand clamp and clamp 33*b* providing a right-hand clamp for the system 20.

Figure 7:
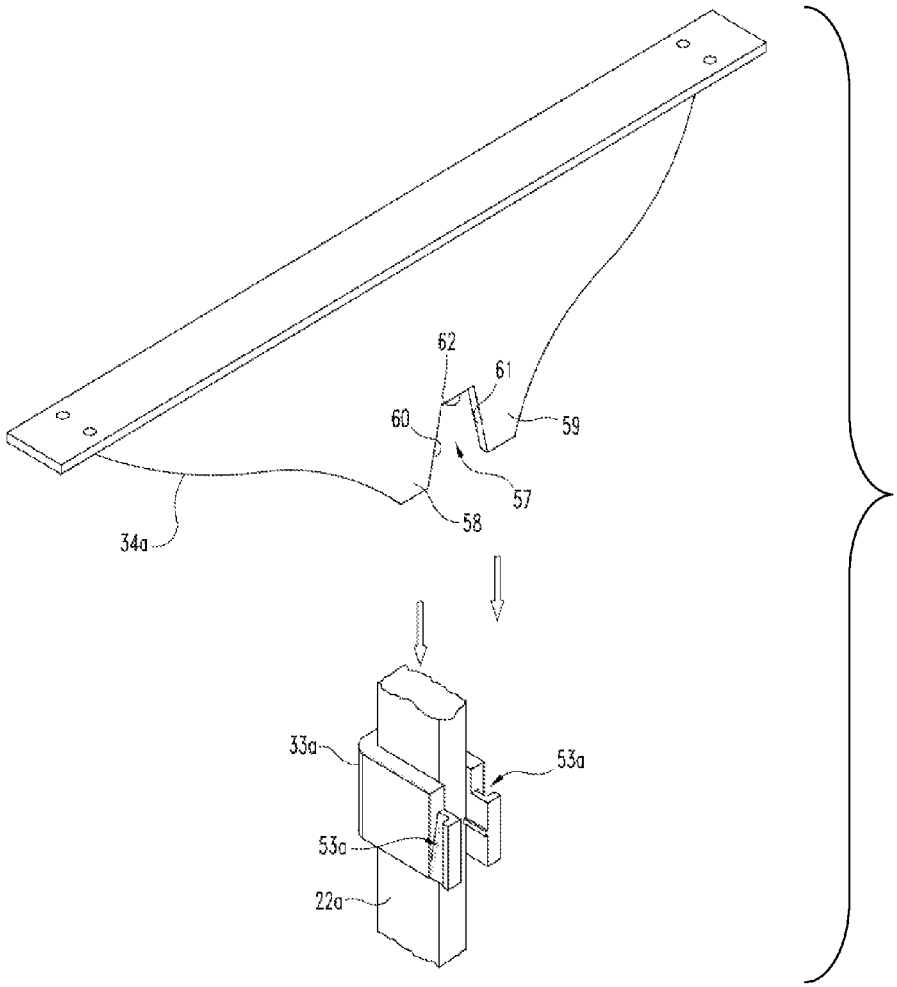
FIG. 7 is a partially exploded cutaway view of selected component portions of the apparatus of FIGS. 1-4.

Referring now to FIG. 7, shown is a partially exploded cut-away view showing certain components of system 20 of FIGS. 1-4. In particular, shown are bracket 34*a*, clamp 33*a* and a segment of arm 28*a* of post 22*a*. As can be seen, clamp 33*a* is received partially surrounding arm 28*a*, with rib 56*a* positioned within one of grooves 32*a*. This arrangement can, for example, be achieved by pressing clamp 33*a* onto arm 28*a* laterally from its outer side (left side of FIG. 2) with rib 56*a* aligned with groove 32*a*. In this manner, clamp 33*a* is fixed in its vertical position on arm 28*a* due to the impingement of rib 56*a* upon surfaces of groove 32*a*. Bracket 34*a* at its lower end includes a tapered slot 57 defined between adjacent portions 58 and 59. Slot 57 has a periphery defined by edge walls 60, 61 and 62 of bracket 34*a*. To connect bracket 34*a* to support clamp 33*a*, bracket 34*a* can be positioned with edge walls 60 and 61 aligned with respective surfaces 54*a* of receivers 49*a* and 50*a* of clamp 33*a*, and forced downwardly onto receivers 49*a* and 50*a* to mount bracket 34*a* to clamp 33*a*. A snug and potentially friction fit of walls 60 and 61 of bracket 34*a* within slots 53*a* is preferred, in order to avoid undue wobbling or other movement of bracket 34*a* when mounted upon clamp 33*a*. Thereafter, a corresponding operation can be carried out to mount clamp 33*b* upon post arm 28*a* and bracket 34*b* upon clamp 33*b*. A shelf can then be attached to brackets 34*a* and 34*b* with screws or other suitable connectors.

In respect of the connection of clamps 33*a* and 33*b* to their corresponding posts and/or brackets, it will be understood that other arrangements could also be used within the scope of certain aspects of the invention. For example, in certain embodiments, these components could be connected by suitable connectors such as screws, rivets, welding, bonding agents, or the like. In beneficial embodiments, however, these clamps are securely connected to their corresponding post and/or bracket pieces without the use of permanent connection arrangements, but rather are connectable and separable by simple manual operations by the user, e.g. as in the case of close fit, friction fit, detent fit, or other similar manually reversible modes of connection. In addition, as one alternative example, a supportive connection between the posts and the support clamps could also be achieved by the incorporation of a series of ribs or other protuberances upon the posts, with corresponding grooves or other similar openings in the support clamps. These and other variations in the cooperation of elements as or similar to those described herein will be understood by skilled artisans as being encompassed by certain embodiments protected herein.

Figure 8:
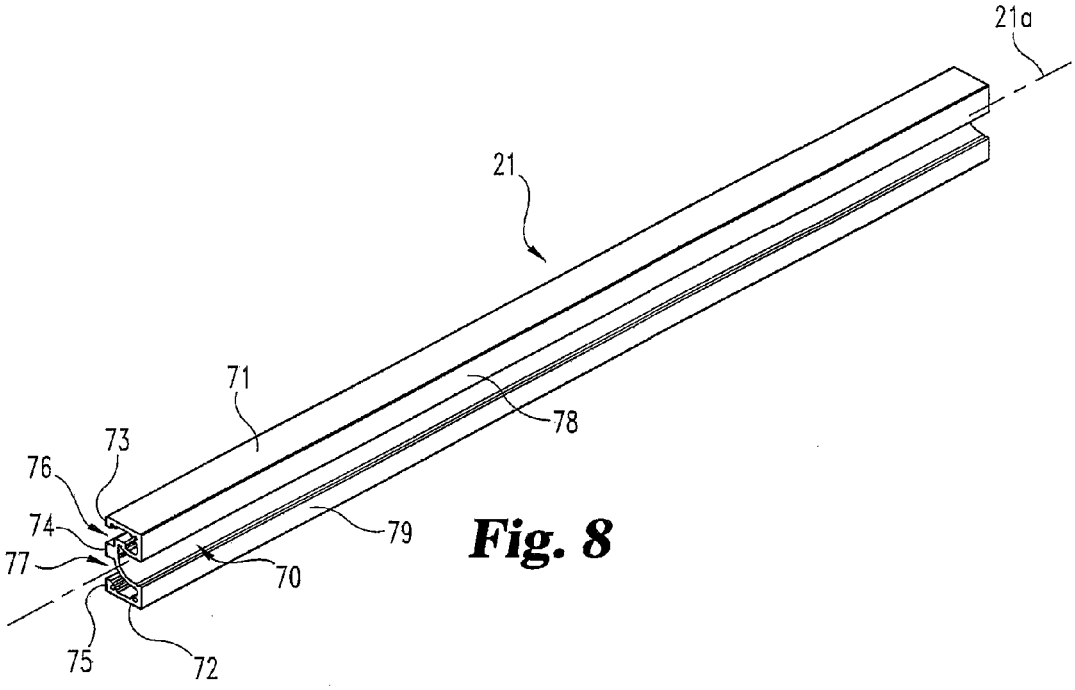
FIG. 8 is a perspective view of an extruded rail comprising one portion of the FIG. 1 display system.
Figure 9:
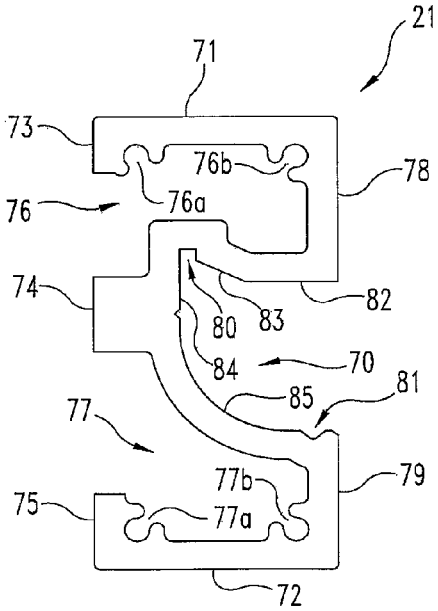
FIG. 9 is an end elevational view of the FIG. 8 rail.

Referring now to FIGS. 8 and 9, rail 21 is desirably an elongate extruded piece, and has a generally rectangular shape in lateral cross section. Upper surface 71 is generally rectangular, substantially flat, and substantially parallel to lower surface 72 which is also generally rectangular in shape and substantially flat. The rear surface is substantially flat and includes three rear surface portions 73, 74, and 75 that define the openings to interior channels 76 and 77. The substantially flat front surface includes front surface portions 78 and 79 that define the opening for shaped channel 70. The upper interior corners 76*a* and 76*b* of channel 76 are constructed and arranged as cylindrical forms for receiving the threaded fasteners 41 that are used to attach endplates 40 to the exposed ends of the extruded rail 21 (see FIGS. 1 and 3). A similar construction exists for the lower interior corners 77*a* and 77*b* of channel 77. These cylindrical forms are used to complete the attachment of endplates 40. The four-clearance hole pattern in each endplate 40 dimensionally corresponds to the spacing and pattern of the four interior corner cylindrical forms 76*a*, 76*b*, 77*a*, and 77*b*. The rectangular shape and size of each endplate 40 corresponds to the lateral cross section (rectangular) shape and size of extruded rail 21. The effect of this sizing and shaping is to provide a clean and neat finished appearance, as illustrated in FIG. 1, without any noticeable offset edges or gaps between endplate 40 and the periphery of rail 21, as viewed fro either end of rail 21.

The remainder of the shaping of each channel 76 and 77 accomplishes another beneficial result. By reducing the amount of material of rail 21, the weight of the rail is reduced, thereby contributing to the efficient and effective design of rail 21. Shaped channel 70 includes an upper, inner corner trough 80 with a substantially square lateral cross section and a lower, outer groove 81. The other surfaces of the extruded and shaped channel 70 include horizontal upper surface 82, inclined surface 83, flat rear wall portion 84, and curved interior surface 85. Trough 80 and groove 81 receive portions of each puck 27. The interfit of portions of puck 27 within trough 80 and within groove 81 help to stabilize the installed structures such as hooks 38,39, brackets 35*a*,35*b* and posts 22*a*,22*b* against lateral forces due to side impact. Forces that might tend to deflect the display structures moving centerline 27*a* off of its perpendicular relationship to centerline 21*a* are resisted by described interfit of the puck 27 portions into trough 80 and groove 81 of channel 70. Straight vertical pull out of a puck 27 from within channel 70 is prevented, in part, by the interfit of a puck 27 rib into trough 81 and in part by the dimensional sizes. Removal, like insertion, involves a pivoting movement of the puck 27 relative to the shaped interior form of channel 70.

Figure 10:
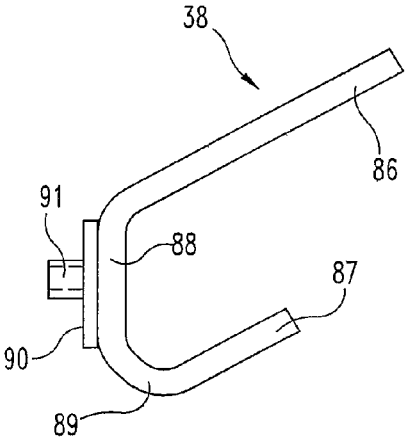
FIG. 10 is a side elevational view of a rail hook comprising one portion of the FIG. 1 apparatus.
Figure 11:
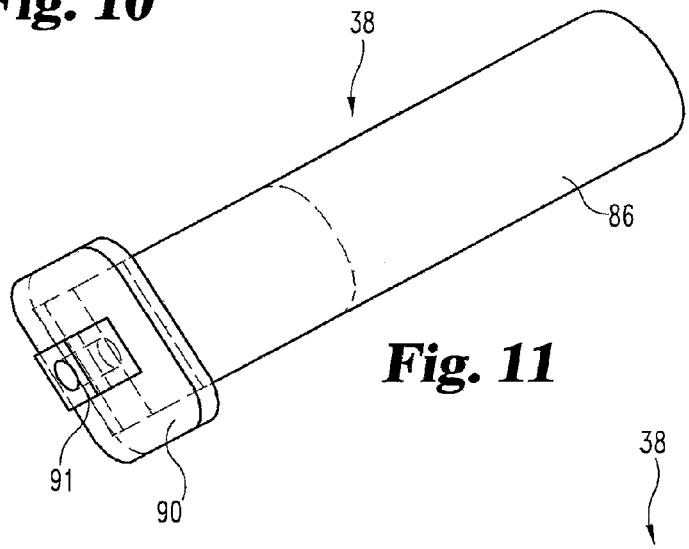
FIG. 11 is a perspective view of the FIG. 10 rail hook.
Figure 12:
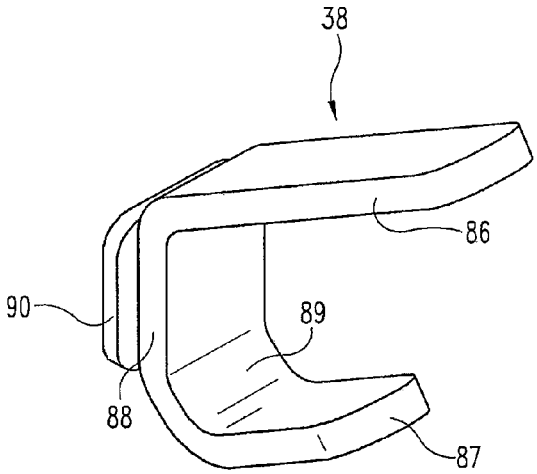
FIG. 12 is a perspective view of the FIG. 10 rail hook.
Figure 13:
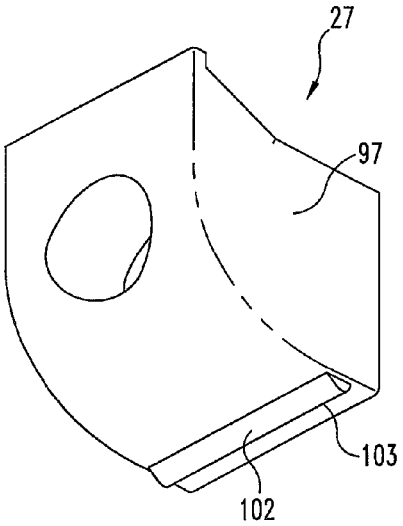
FIG. 13 is a perspective view of a puck comprising one portion of the FIG. 1 apparatus.
Figure 14:
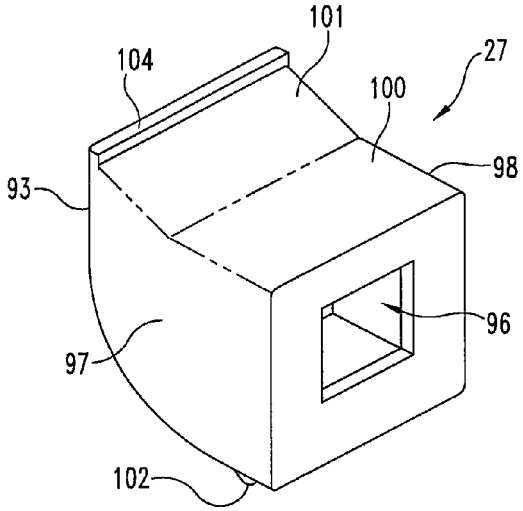
FIG. 14 is a perspective view of the FIG. 13 puck.
Figure 15:
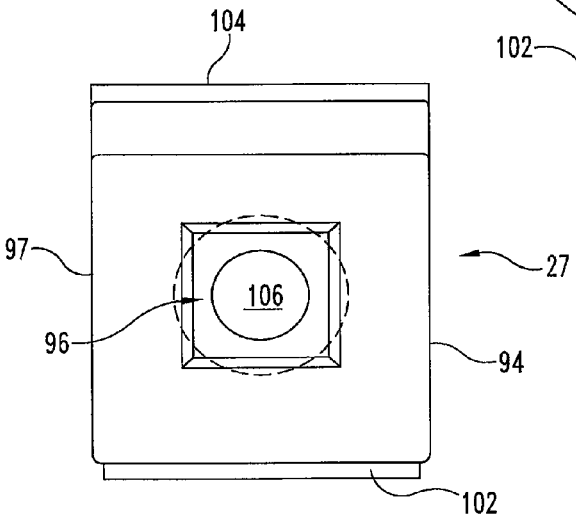
FIG. 15 is an end elevational view of the FIG. 13 puck.
Figure 16:
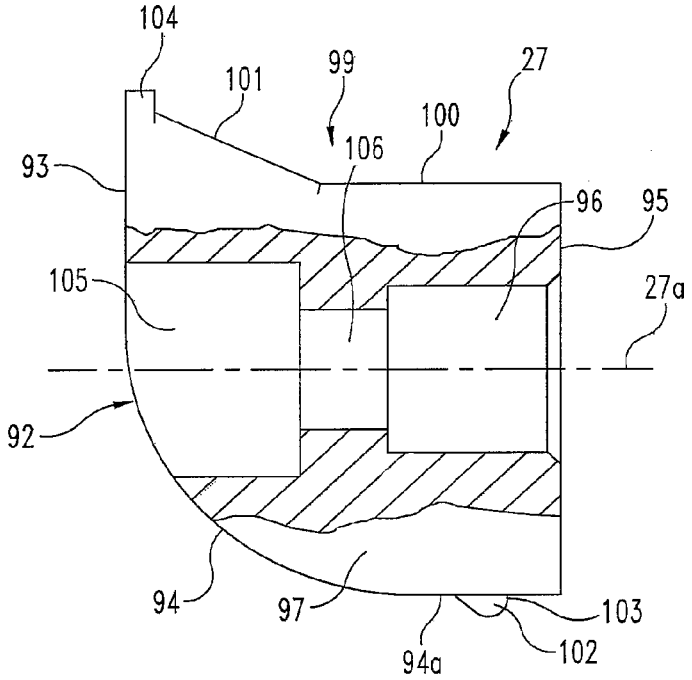
FIG. 16 is a fragmentary, side elevational view of the FIG. 13 puck.

Referring now to FIGS. 10-12, a representative hook 38 is illustrated, though it should be understood that the specific hook shape, as well as its size, are optional characteristics. At the rear of hook 38 are a back plate 90 and square nut 91. It will be understood that in the illustrated embodiment of FIGS. 1-4, identical components occur at the back sides of posts 22*a*,22*b* and upper shelf brackets 35*a*,35*b*, to facilitate their mounting to rail 21. Likewise, the puck 27 attached to each of these components can be identical. With a puck 27 properly and securely attached, whatever the remainder of the form might be for the mounted component, whether a shelf arm or post, a hook, a bracket, or something else, it is possible to properly and securely insert the puck 27 into the shaped channel 70 with the desired fit and preferred method of connection. This means that virtually any type of display, storage or support structure can be inserted into the extruded rail 21 so long as the "standardized" puck 27 is properly attached, which in turn suggests the use of a back plate and a square nut as the preferred construction.

Hook 38 includes a flat form shaped into an upper prong 86, lower lip 87, rear wall 88, and curved section 89. As noted, the particular size, shape, and styling of hook 38 are variables, considering that its primary purpose is to hold and/or display articles. Consequently, depending on whether those articles are going to be supported by hangers or some other type of device, that will influence the particular styling of the hooks 38. The back plate 90 is integral with the outer surface of rear wall 88. The included angle between prong 86 and rear wall 88 is approximately 120 degrees. The included angle between lower lip 87 and rear wall 88 is approximately 60 degrees. In terms of relative sizes for illustrative purposes only, upper prong 86 is between 2.5 and 3.0 inches in length and approximately 0.87 inches in width. Lower lip 87 is approximately 1.2 inches in length and 0.87 inches in width. Rear wall 88 is approximately 1.2 inches in height and 0.87 inches in width.

Referring now to FIGS. 13-16, a "standard" puck 27 for compatible insertion into shape channel 70 includes a specific contoured shape that facilitates the preferred manner of assembly and use. Puck 27 includes a forward face 92 with a substantially flat upper portion 93 and a lower curved portion 94 that flattens out into portion 94*a*. A substantially flat rear face 95 has a substantially square shape symmetrically surrounding a square-shaped opening 96. Sides 97 and 98 are substantially flat and parallel to each other. The upper surface 99 includes a substantially flat portion 100 and an inclined portion 101. Rear face 95 is substantially perpendicular to sides 97 and 98 and portion 100 and is substantially parallel with upper portion 93. Provided as part of portion 94*a* is a depending rib 102 which is rounded and angled toward rear face 95 with a curved free end 103. Provided at the edge junction between upper portion 93 and inclined portion 101 is a raised rib 104. Rib 104 is substantially square in lateral cross section and rectangular in longitudinal cross section.

Square-shaped opening 96 is in communication with larger cylindrical opening 105 via smaller cylindrical opening 106. These three openings are coaxially centered on puck centerline 27*a*. Opening 96 is constructed and arranged to receive the square nut 91 (see FIG. 10) of whatever accessory component is being selected for insertion into shaped channel 70 of rail 21. The square nut 91 is sized for a close fit, but still within some slight clearance. These cooperating square shapes prevent any rotation of the accessory component within the puck 27. The square nut is internally-threaded for a ¼-20 thread and a headed, ¼-20 fastener (not shown) is used to complete and secure the puck 27 and square nut 91 connection. Opening 105 accepts the larger head of the threaded fastener, while opening 106 accepts the threaded body. With the threaded fastener fully tightened in place, the rear face 95 is pulled tightly up against back plate 90. The puck 27 and square nut 91 now function as an integral unit.

Puck 27 and shaped channel 70 are compatibly sized and shaped for a close interfit of puck 27 into channel 70. Direct horizontal insertion of puck 27 into channel 70 is not possible due to the projected vertical size of the channel opening relative to the overall vertical height of puck 27 from rib 102 to the top of rib 104. For example, this overall height of puck 27 is approximately 1.23 inches while the vertical height of the channel 70 opening is approximately 0.99 inches. Instead, proper insertion is achieved by pivoting the puck 27 in a counter clockwise direction based on the FIG. 9 orientation, assuming that rail 21 is aligned on both horizontal and vertical geometric planes. This pivoting motion lowers rib 104 below upper surface 82 and allows the rib 104 to be inserted into the shaped channel 70. Thereafter, the puck 27 is pivoted in a clockwise direction (still based on the FIG. 9 orientation) as the puck is pushed deeper into the shaped channel 70. Completed insertion (i.e., assembly) of the puck 27 positions rib 104 in trough 80 and positions rib 102 in groove 81. All other surfaces of puck 27 and channel 70 have a similar shape and close size conformance, as well as close positioning. For example, puck 27 measures approximately 0.969 inches from surface 94*a* to surface 100. Channel 70 measures approximately 0.995 inches for the opening from surface 82 to the lower surface that defines grove 81. As should be understood from the drawings and foregoing description, the puck 27 cannot be pulled out of channel 70 horizontally and any weight placed on the associated display component, such as a hook 38 or shelf posts 22*a*,22*b* tends to try and pivot the puck 27 in a clockwise direction due to the cantilever arrangement of the hook 38 and shelf posts 22*a*,22*b* and the downward force that is applied at a distance outwardly from the rail 21. When it is desired to remove a rail-mounted accessory, the particular item is pivoted upwardly in a counterclockwise direction, still based on FIG. 9 as the reference, and as this counter-clockwise movement is being effected, the display accessory is pulled outwardly away from rail 21. With sufficient clearance between a puck 27 and the shaped channel 70, an inserted puck 27 can be manually moved laterally in either direction along the length of channel 70. This permits selectively positioning and spacing of the hooks 38,39, shelf posts 22*a*,22*b*, and/or upper shelf brackets 35*a*,35*b*, for example, after insertion into rail 21. As for the mentioned side impact forces that might twist the display accessory and perhaps cause the puck to pop out of its inserted position, the two ribs 102 and 104 and their interfit into troughs 81 and groove 80, respectively, provide bracing and stiffening to resist that type of side loading and twisting motion.

The preferred materials for each component part of display fixture 20 include aluminum for rail 21, metal for shelf posts 22*a* and 22*b*, metal with a polished chrome finish for hooks 38 and 39, metal with a polished chrome finish for brackets 35*a* and 35*b*, metal for support clamps 33*a* and 33*b* (desirably injection molded metal pieces), wood veneer for shelves 23 and 24, steel with a polished chrome finish for endplate 40, and metal or plastic for puck 27.

Figure 2:
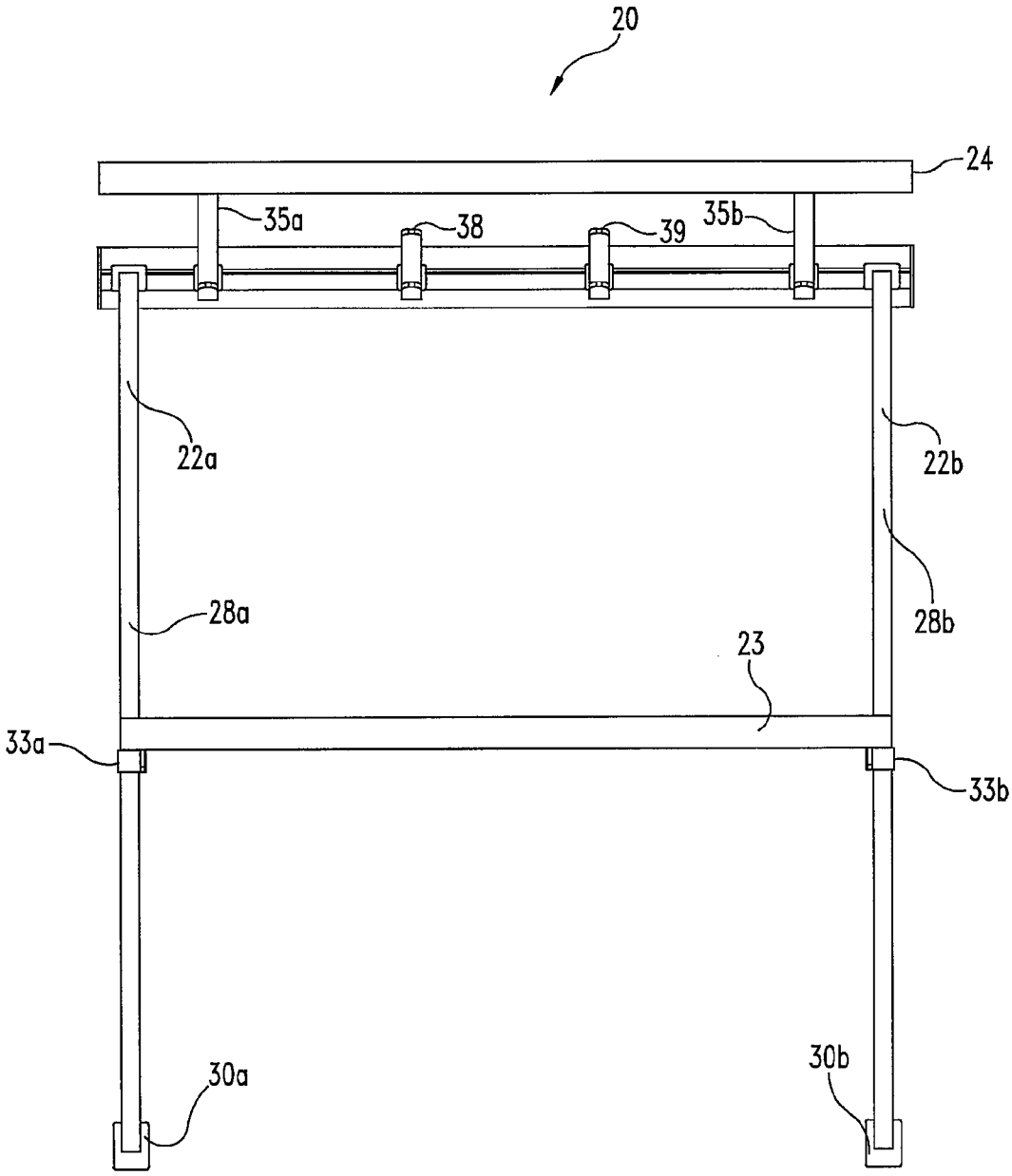
FIG. 2 is a front elevational view of the FIG. 1 apparatus.

With reference to FIGS. 18-23, shown are other components that can be used in substitution for brackets 34*a*, 34*b* and shelf 23 in the system of FIGS. 1-3, to provide alternative wire shelves in the system. In particular, the components illustrated in FIGS. 18-23 can be used along with rail 21, posts 22*a* and 22*b* with associated pucks 27, and support clamps 33*a* and 33*b*, to provide alternative storage systems. These alternative storage systems incorporate support bars with ends that mount to support clamps 33*a* and 33*b*, and wire shelves that in turn mount to the support bars. It will be understood in this regard that corresponding or similar integral components including both support bars and wire shelves could also be used.

Figure 18:
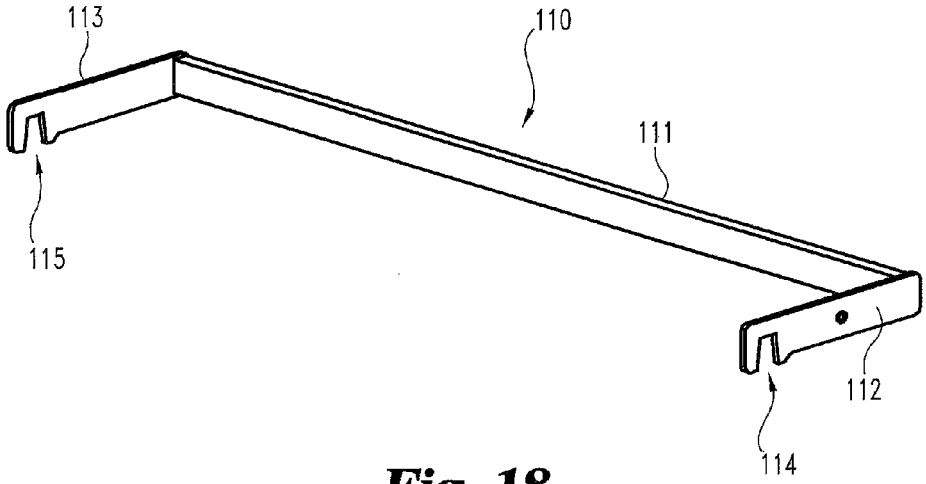
FIG. 18 is a perspective view of a shelf support bar comprising a portion of an apparatus disclosed herein.
Figure 19:
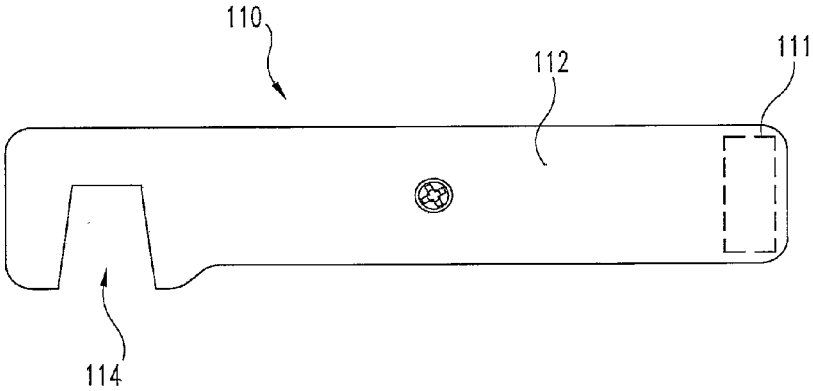
FIG. 19 is a side view of the support bar of FIG. 18.
Figure 20:
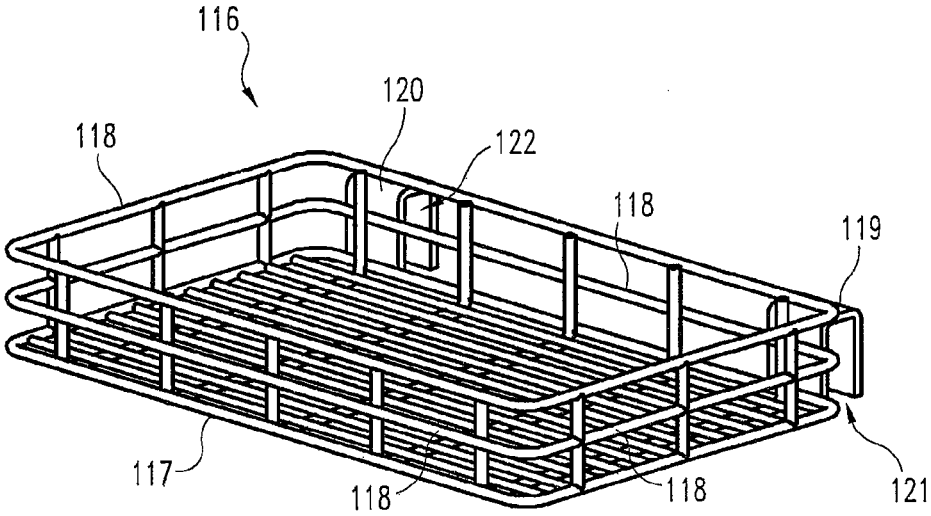
FIG. 20 is a perspective view of a basket shelf comprising a portion of a shelving apparatus disclosed herein.
Figure 21:
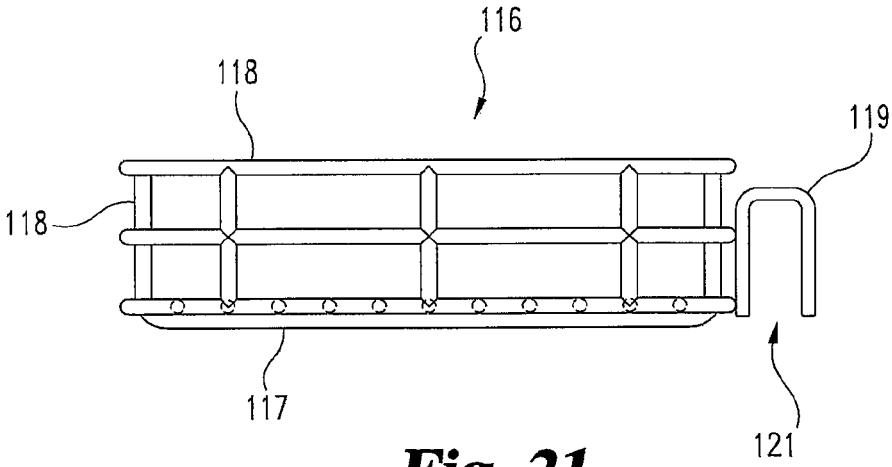
FIG. 21 is a side view of the basket shelf of FIG. 20.

Turning in particular now to FIGS. 18-19, shown are a perspective and side views, respectively, of support bar 110. Support bar 110 includes an elongate central bar 111 and first and second end bars 112 and 113 connected to the respective ends of central bar 111 and extending transversely (desirably perpendicularly) thereto. End bars 112 and 113 are equipped with tapered slots 114 and 115, respectively, which are shaped and sized for snug fit with receiver slots 53*a* and 53*b* (see FIGS. 6 and 6A) of support clamps 33*a* and 33*b*, respectively. In this manner, support bar 110 can be press fit down onto support clamps 33*a* and 33*b* when received on posts 22*a* and 22*b*, respectively (see e.g. FIG. 1). FIGS. 20 and 21 provide perspective and side views, respectively, of basket shelf 116 that is mountable upon support bar 110. Basket shelf 116 includes a wireframe structure having a bottom wall 117 and sidewalls 118. Mounted at the back of basket shelf 116 are first and second "U"-shaped mount members 119 and 120, sized and shaped to snugly mount over central bar 111 of support bar 110. With reference also now to the system depicted in FIGS. 1-3, in this fashion, with support bar 110 mounted on clamps 33*a* and 33*b* with end bars 112 and 113 extending in the direction of the wall 200, basket shelf 116 can be press-mounted downwardly onto support bar 110 by aligning mount members 119 and 120 overtop central bar 111 and forcing mount members 119 and 120 downwardly to receive central bar 111 into the slots 121 and 122 of mount members 119 and 120, respectively.

Figure 22:
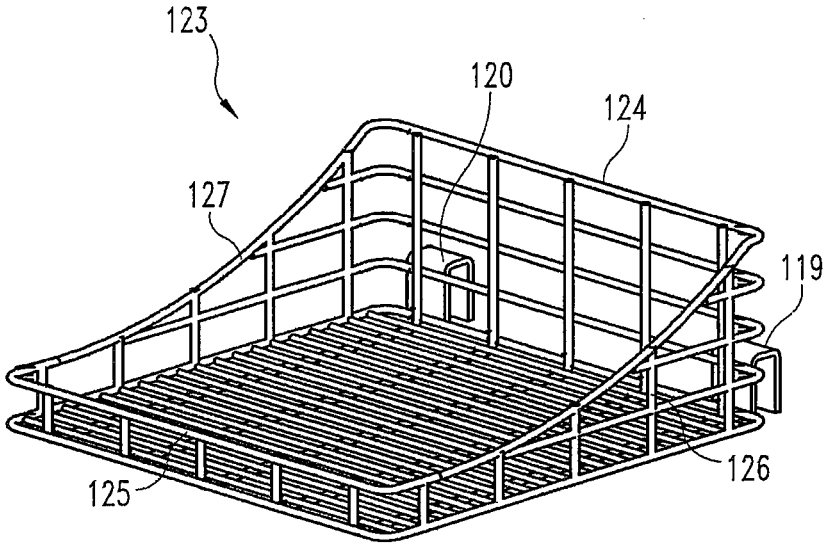
FIG. 22 is a perspective view of another basket shelf comprising a portion of a shelving apparatus disclosed herein.
Figure 23:
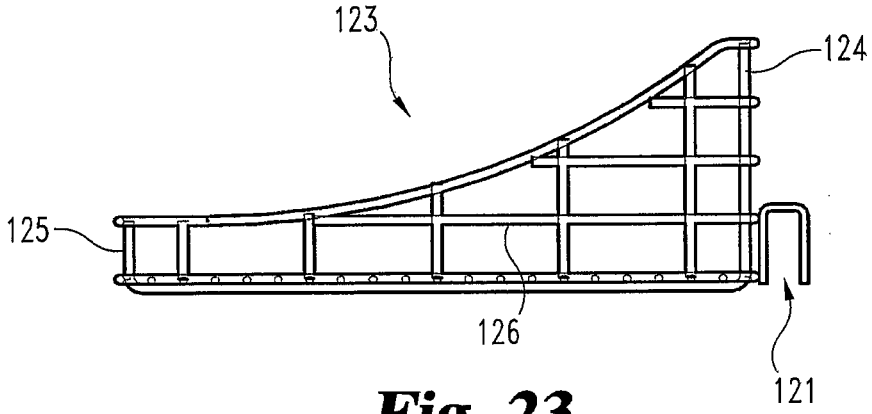
FIG. 23 is a side view of the basket shelf of FIG. 22.

Referring now to FIGS. 22 and 23, shown are perspective and side views of An alternate basket shelf 123 that can be used instead of or in addition to basket shelf 116 in systems of the invention. Basket shelf 123 is similar in design to shelf 116, except having a greater depth "D", a rear wall 124 with a height greater than front wall 125, and sidewalls 126 and 127 each having=increasing height as they extend from front wail 125 toward rear wall 124. In this fashion, a basket shelf 123 having deeper portions can be provided.

Additional shelving and/or hook systems that can incorporate rails, pucks and potentially other components disclosed herein are disclosed in the provisional U.S. Patent Application Ser. No. 60/898,538 of Kirk J. Botkin entitled SUPPORT SYSTEMS AND COMPONENTS USEFUL FOR HOOK AND/OR SHELVING ARRANGEMENTS filed on Jan. 31, 2007, which is hereby incorporated by reference in its entirety for all purposes, including for disclosures of other components and systems to be supported by rail/puck components as disclosed herein.

While the preferred embodiment of the invention has been illustrated and described in the drawings and foregoing description, the same is to be considered as illustrative and not restrictive in character, it being understood that all changes and modifications that come within the spirit of the invention are desired to be protected.

The invention claimed is:

1. A shelf apparatus, comprising:

a rail mounted to an upstanding surface;

a first upstanding post attached to a first puck interfit into a first opening region of the rail, the first upstanding post having a plurality of horizontally-extending grooves in an external surface thereof, said grooves spaced vertically from one another, the first upstanding post spaced from the upstanding surface to which the rail is mounted;

a second upstanding post attached to a second puck interfit into a second opening region of the rail, the second upstanding post having a plurality of horizontally-extending grooves in an external surface thereof, said grooves spaced vertically from one another, the first upstanding post spaced from the upstanding surface to which the rail is mounted;

a first shelf support clamp supported by said first upstanding post, the first shelf support clamp having a clamp body received only partially about said first upstanding post, said first shelf support clamp further including a horizontally-extending rib portion received in one of said grooves of said first upstanding post;

a second shelf support clamp supported by said second upstanding post, the second shelf support clamp having a clamp body received only partially about said second upstanding post, the second shelf support clamp further including a horizontally-extending rib portion received in one of said grooves of said second upstanding post;

a first shelf bracket supported by said first shelf support clamp;

a second shelf bracket supported by said second shelf support clamp; and a shelf supported by said first and second shelf brackets, the shelf including a first shelf portion extending from positions adjacent the first and second posts and toward the upstanding surface to which the rail is mounted and a second shelf portion extending from said positions adjacent the first and second posts and away from the upstanding surface to which the rail is mounted.

2. The apparatus of claim 1, wherein said first puck as interfit within the first opening region has a vertical dimension greater than the vertical dimension of the first opening region, and said second puck as interfit within the second opening region has a vertical dimension greater than the vertical dimension of the second opening region.

3. The apparatus of claim 2, wherein the first and second pucks are attached to said first and second upstanding posts, respectively, by horizontally-extending posts.

4. The apparatus of claim 1, wherein:

said first and second upstanding posts have a generally rectangular cross section.

5. The apparatus of claim 1, wherein:

said first and second shelf support clamps each define a generally rectangular channel, and wherein said posts are received in said channels.

6. The shelf apparatus of claim 1, wherein said first and second support clamps each define a slot for receiving a portion of said first and second brackets, respectively.

7. The shelf apparatus of claim 1, wherein said grooves defined in said first and second posts only partially circumscribe the periphery of said posts.

8. The shelf apparatus of claim 7, wherein said posts each have a generally rectangular cross section, and wherein said grooves are defined in only one face of said posts.

9. The shelf apparatus of claim 8, wherein said first and second support clamps each define a rib, with said ribs each received in one of said grooves.

10. A shelf support clamp for mounting on a shelf support post having a substantially horizontal groove, the shelf support clamp comprising:

a clamp body defining an interior channel for receipt about the shelf support post, the interior channel including a top opening, a bottom opening, and a side opening, and the clamp body defining walls of the interior channel including a back wall opposite the side opening, a first side wall extending from the side opening to the back wall, and a second side wall extending from the side opening to the back wall; and said body further defining a rib extending into said interior channel for receipt within the groove of the shelf support post, with the rib protruding from the first side wall and extending from the side opening to the back wall.

11. The clamp of claim 10, wherein said post has a generally rectangular cross section, and wherein said back wall, first side wall and second side wall are configured for receipt against three faces of said post.

12. The clamp of claim 10, wherein said clamp body further defines at least one slot for cooperation with a shelf bracket to be supported by said shelf support clamp.

13. The clamp of claim 12, wherein:

said first and second side walls each have an exposed end face; and said slot is defined by first and second receiver elements connected to the end faces of said first and second walls, respectively.

14. A combination comprising: a shelf support clamp of claim 10; and a shelf support bracket supported by said shelf support clamp.

15. The combination of claim 14, wherein: said shelf support clamp defines at least one slot; and said bracket has a portion received in said slot.

16. A combination comprising:

a shelf support post; and a shelf support clamp of claim 10 supported on said shelf support post.

17. The combination of claim 16, wherein:

said post comprises at least one substantially horizontal groove; and said clamp comprises a protuberance received in said groove.

18. The combination of claim 16, also comprising: a shelf support bracket supported by said shelf support clamp.

19. The combination of claim 18, also comprising:

a shelf attached to said bracket.

20. A shelf apparatus, comprising:

a rail mounted on a wall, said rail including an elongate opening;

a first post member supported by said rail, the first post member including a first portion engaged in said elongate opening, a downwardly-depending arm connected to said first portion and extending downwardly in a first path spaced from the wall, and a second portion attached to said arm and contacting said wall at a position below said rail;

a second post member supported by said rail, the second post member including a first portion engaged in said elongate opening, a downwardly-depending arm connected to said first portion and extending downwardly in a second path spaced from the wall, and a second portion attached to said arm and contacting said wall at a position below said rail; and at least one shelf supported by said first and second post members, the at least one shelf including a first shelf portion extending in a direction horizontally from the downwardly-depending arms toward the wall and a second shelf portion extending in a direction horizontally from the downwardly-depending arms away from the wall.

21. The apparatus of claim 20, also comprising:

a first support clamp supported on said first post member and a first bracket supported by said first support clamp;

a second support clamp supported on said second post member and a second bracket supported by said second support clamp; and wherein said shelf is attached to said first and second brackets.

22. The apparatus of claim, 20, also comprising:

a first support clamp supported on said first post member;

a second support clamp supported on said second post member;

one or more shelf support members supported by said first and second support clamps; and wherein said shelf is supported by said one or more shelf support members.

23. The apparatus of claim 22 wherein said one or more shelf support members includes first and second brackets supported by said first and second support clamps, respectively.

24. The apparatus of claim 22 wherein said one or more shelf support members includes a single shelf support element extending between and supported by said first and second support clamps.

* * * * *